US006339296B1

(12) United States Patent
Goral

(10) Patent No.: US 6,339,296 B1
(45) Date of Patent: Jan. 15, 2002

(54) LOW PROFILE EMERGENCY BALLAST

(76) Inventor: Jerzy M. Goral, 1624 Red Barn Dr., Cordova, TN (US) 38018

( * ) Notice: Subject to any disclaimer, the term of this patent is extended or adjusted under 35 U.S.C. 154(b) by 0 days.

(21) Appl. No.: 09/568,843

(22) Filed: May 11, 2000

Related U.S. Application Data

(60) Provisional application No. 60/133,439, filed on May 11, 1999.

(51) Int. Cl.[7] ..... H05B 37/00

(52) U.S. Cl. ..... 315/86; 315/209 T; 315/219; 315/224; 315/276; 315/283; 315/360

(58) Field of Search ..... 315/88, 86, 206, 315/209 R, 209 T, 219, 224, 276, 283, 360, DIG. 2, DIG. 5, DIG. 7

(56) References Cited

U.S. PATENT DOCUMENTS 3,688,123 A * 8/1972 Walker ..... 315/86
4,029,993 A * 6/1977 Alley et al. ..... 315/219
4,117,373 A * 9/1978 Alley ..... 315/86
4,277,728 A * 7/1981 Stevens ..... 315/DIG. 5
4,323,820 A * 4/1982 Teich ..... 315/86
4,751,398 A * 6/1988 Ertz, III ..... 315/86
4,803,406 A * 2/1989 Yasuda et al. ..... 315/DIG. 7
4,977,351 A * 12/1990 Bavaro et al. ..... 315/86
5,004,953 A * 4/1991 McDonald ..... 315/360
5,416,384 A * 5/1995 Bavaro ..... 315/DIG. 2
5,666,029 A * 9/1997 McDonald ..... 315/86

* cited by examiner

*Primary Examiner*—Don Wong
*Assistant Examiner*—Thuy Vinh Tran
(74) *Attorney, Agent, or Firm*—Garvey, Smith, Nehrbass & Doody, L.L.C.

(57) ABSTRACT

An emergency ballast for a low profile fluorescent lamp fixture including an AC ballast including an end of lamp life shut down circuit. The emergency ballast includes a timing circuit which operates when AC power is restored to the lamp fixture after the fixture has operated for some period of time due to AC power failure. The timing circuit delays the application of AC power to the AC ballast for a given period of time (conveniently about 5 seconds) during the cessation of operation of the emergency ballast because of the restoration of AC power.

6 Claims, 1 Drawing Sheet

LOW PROFILE EMERGENCY BALLAST

CROSS-REFERENCE TO RELATED APPLICATION

This application relates to Provisional Patent Application Ser. No. 60/133,439, filed May 11, 1999.

STATEMENT REGARDING FEDERALLY SPONSORED RESEARCH OR DEVELOPMENT

Not Applicable

BACKGROUND OF THE INVENTION:

1. Field of the Invention

The invention relates to emergency lighting, and particularly to fluorescent lighting wherein a ballast for a fluorescent lamp is connected to a source of electrical energy other than normal AC line current in the event that the normal AC current fails.

Emergency lighting is required in commercial, industrial, and institutional buildings just as fire extinguishers, smoke alarms and other safety equipment. Three types of emergency lighting are common in such installations: unit equipment, engine generators and central battery systems. Unit equipment falls into two principle types: fluorescent and incandescent.

The fluorescent units are customarily combined with and within a conventional fluorescent lighting unit by merely adding the emergency ballast consisting of a battery, a battery charger, inverter and sensing circuitry adjacent the standard fluorescent AC ballast. The sensing circuit of the emergency ballast observes the interruption of normal AC power to the lamp unit and immediately switches on the emergency ballast to power individual lamp(s) or the light fixture for the required period which, under most state safety codes, is a period of at least ninety (90) minutes, a standard called out in the National Electrical Code, NFPA Article 70, and NFPA Article 101 Light Safety Code.

2. General Background of the Invention

U.S. Pat. No. 5,004,953 entitled Emergency Lighting Ballast for Compact Fluorescent Lamps with Integral Starters, assigned to the assignee of the present invention is illustrative of the general fluorescent type of emergency lighting with a ballast. It is common in the installation of emergency fluorescent lighting that an emergency ballast is added to a conventional fluorescent fixture or provided integrally in a fixture having internal regular and emergency ballast installed. When main AC power fails, voltage sensing circuitry instantly connects DC current from a battery (in the emergency ballast) to an inverter which produces high frequency, high voltage power to illuminate the emergency fluorescent lamp(s) for the required period.

The present invention is directed to fluorescent lighting fixtures which incorporate small fluorescent lamps, such as those which have a smaller diameter than conventional fluorescent bulbs (e.g. about ⅝"). These lamps are coming into more common usage and are employed in single or multiple lamp, low profile fixtures. In such small diameter lamps, the cathodes at the lamp ends are very close to the glass envelope. When this type of fluorescent lamp approaches end of its normal life, high power is generated in the cathodes, which may get very hot and can crack the glass open adjacent the cathode heaters. Standard ballasts would continue to supply high voltage to the cracked lamp, which would create potentially dangerous exposure to laceration if someone would try to unknowingly replace cracked glass lamps, as by causing further cracking or open breakage of the glass envelope and impingement of the sharp edges into the skin. The continued operation of the AC ballast with the damaged (unilluminated) lamp may also create an electrical shock hazard were the glass to disintegrate and allow an individual to touch the "hot" cathode (i.e., one carrying high voltage).

To prevent this electrical shock hazard, the electronic AC ballasts for small fluorescent lamps now include an end-of-lamp-life shut down circuit. These A.C. ballasts now incorporate a circuit to sense the increased cathode voltage and shut the high voltage down that normally would be supplied to the cracked lamp. Manufacturers that sell ballasts incorporating such a feature are Energy Savings Inc. (Lamp Guard, or Super Lamp Guard), Osram Quicktronic, and Magnetek.

These new electronic shutdown circuits conventionally sense any sudden change in power supplied to the lamp, such as a sudden increase in AC voltage or any DC voltage developed across the lamp. If any of these conditions is detected, the AC ballast operation is shut down such that no high voltage appears at the lamp.

This shut down capability frequently interferes with the inclusion of an emergency ballast which otherwise will operate the lamp in the event of AC power failure. The problem is actually created with the restoration of normal AC power after the lamp has been powered by the emergency ballast as a result of A.C. power failure. With the shift from battery operation of the lamp by the emergency ballast, there are transient swings of voltage and power to the lamp as the emergency ballast output shuts down and the AC ballast resumes operation. These transient voltages frequently trigger the shut down circuit since the transients exhibit symptoms similar to the voltage swings of the small lamp reaching its end-of-life state. The present invention coordinates the restarting of the fluorescent lamps with normal AC power with the cessation of the supply of emergency power from the emergency ballast.

SUMMARY OF THE INVENTION

The present invention is directed to a low profile emergency ballast for operation in conjunction with a low profile AC ballast having an end of lamp life shut down circuit. More particularly, the present invention is directed to an emergency ballast for a fluorescent lamp having means to avoid erroneous action of an end of lamp life shut down circuit in a low profile AC ballast.

One of the objectives of the present invention is the momentary delay of the powering of the lamp by the resumed A.C. power in order to allow the transients exhibited by the shut down of the emergency ballast to subside. A further objective of the present invention is the inclusion of a delay circuit which operates only on A.C. power application directly following operation of the emergency ballast.

DETAILED DESCRIPTION OF THE PREFERRED EMBODIMENTS

Figure 1:
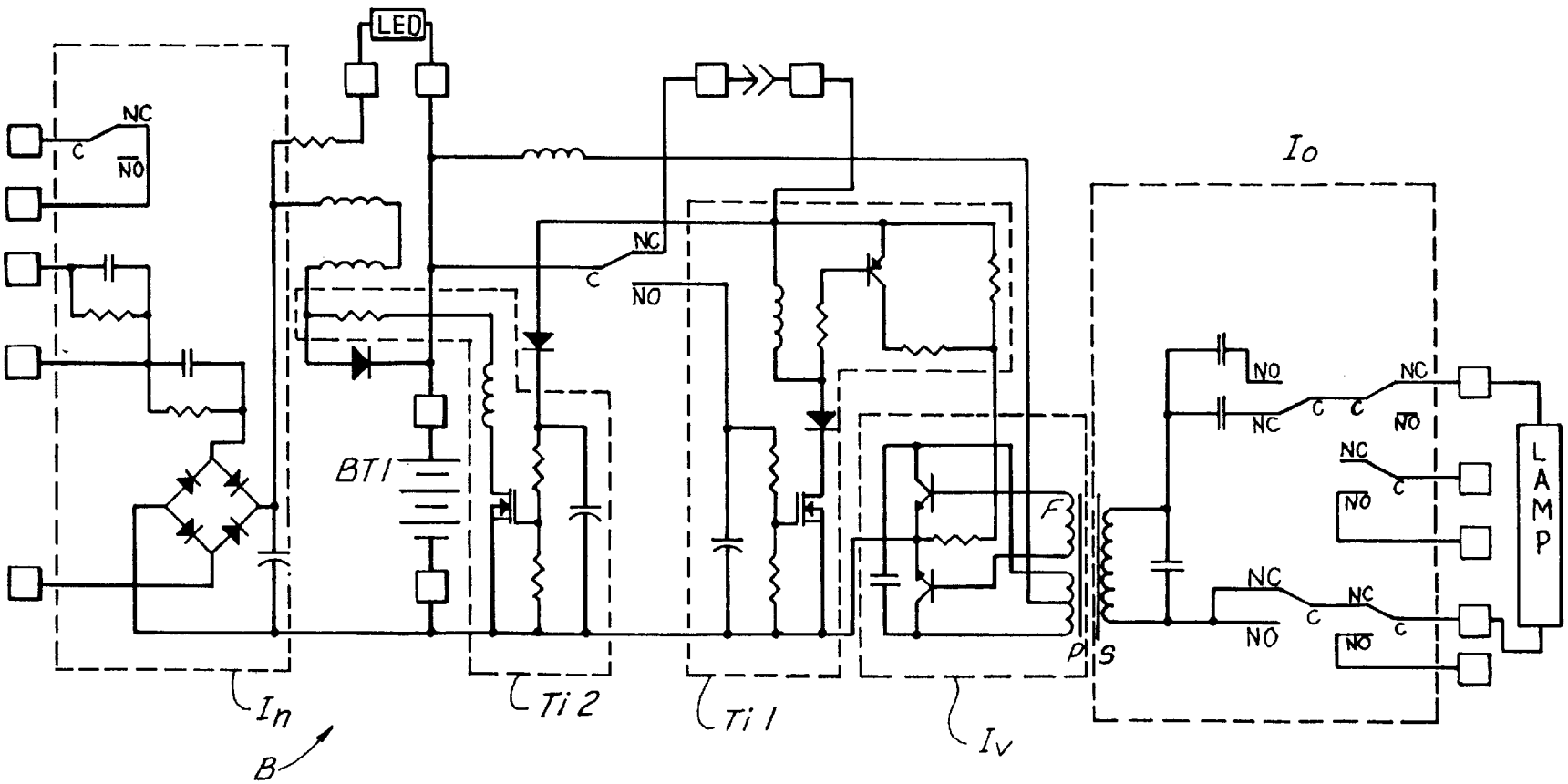
FIG. 1 is a circuit diagram of a preferred embodiment of an emergency ballast for a low profile fluorescent fixture utilizing small fluorescent lamps including a circuit to avoid erroneous action of an end of lamp life shut down circuit in an AC ballast.

The invention is illustrated in the context of a conventional low profile or small (e.g. ⅝" in diameter) fluorescent lamp including an emergency ballast for standby lighting during a period when the main AC power fails. FIG. 1 illustrates the circuit diagram of an emergency ballast according to the present invention which is connected in parallel with a conventional small lamp fluorescent ballast (not shown) for providing emergency lighting in the event of main AC power failure.

The circuitry for a low profile emergency ballast B is illustrated in FIG. 1. This system includes an input/charging circuit $I_n$ which provides charging current to the battery BT1 and disables the emergency operation mode, i.e., places it in standby during the period that AC power is being supplied. The input/charging circuit has first and second input terminals J1-1 and J1-2, respectively, connectable to standard AC voltage sources such as 120 AC and 277 volts AC. Inclusion of alternative voltage connections enables the system to be selectively connected to either standard commercial voltage AC (277 volts AC) or normal residential voltage (120 volts AC). Common, or ground potential, connector J1-4 completes the A.C. power connections to the system input.

The two A.C. supply voltage terminals J1-1 and J1-2 and the common terminal J1-4 are connected to the AC inputs of a rectifier D1 (which in the preferred embodiment is a full wave rectifier), the high voltage (277 v. AC) input terminal J1-2 being connected by means of a series arrangement of a first circuit composed of a capacitor, C1, and a resistor, R1, and a second circuit composed of a capacitor, C2, and a resistor, R2. The lower voltage (e.g. 120 volts AC) terminal is connected to rectifier D1, only via the second circuit including C2 and R2. The capacitors in the circuits serve to limit the charging current supplied to rectifier D1 to a level consistent with the requirements for a charging current to battery BT1. The resistors are included as a safety measure to limit the discharge of power from the capacitors after the A.C. power is removed from the circuits.

The DC output from rectifier D1 is supplied to battery BT1 by means of the coils of two relays, K1 and K2, and a capacitor C3 which filters the current supplied to relay coils K1 and K2. A resistor R3 is connected in series with an LED indicator to show the charging status of the emergency ballast B.

Battery BT1 may be composed of, for example, a high temperature 6 volt (sub-C) nickel cadmium battery. Alternate battery configurations are possible, dictated by the power requirements of load LAMP and size of the battery space available in the emergency ballast.

The output circuit $I_o$ includes a secondary winding S of transformer T having a primary winding P and a feedback winding F on the inverter circuit $I_v$ side of transformer T. Output circuit $I_o$ provides current limiting to the fluorescent lamp load LAMP only to the degree that is necessary to keep the lamp within its normal operating limits. The output $I_o$ circuit also provides switching by switches K1A and K1B and K2A between normal lamp operation (K1 and K2 energized) and the emergency ballast mode (K1 and K2 de-energized) during which the AC power is not available. The output circuit $I_o$ is composed of a capacitor, C9, connected across the output of the secondary winding, S, of transformer T1. Capacitors C7 and C8 are selectively connected as discussed later, in series with the fluorescent lamp LAMP which the output circuit $I_o$ powers. As may be observed by those skilled in the art, the output circuit is remarkably simple in that the output circuit of the emergency ballast B provides only that current limiting necessary to keep the fluorescent lamp within its normal operating limits and allows the lamp to be connected to the otherwise unregulated full-wave AC output created from the energy supplied by battery BT1 through switching performed by the inverter circuit $I_v$.

Emergency power is supplied to load LAMP by battery BT1 through the operation of inverter circuit Iv. The operation of the emergency ballast B is through switch K2A which serves to place the inverter circuit in operation enabling the oscillation of switching transistors Q3 and Q4, including a higher current operation enabled by the timing circuit Ti1 for a short interval (which may be in the order of a few seconds) after AC power failure to permit the starting of the "cold" fluorescent lamp. Those familiar with fluorescent lighting will recognize that an application of an initial voltage of as much as approximately 600 volts may be required to initiate the ignition of the gasses in the standard fluorescent lamp. Irmediately after ignition, as switch Q5 (in addition to battery BT1 through resistor R12) supplies base current to Q3 and Q4 as later discussed, the current regulating capacitors C7 or C8 in the output circuit $I_o$ regulate the current level to that required to operate the fluorescent lamp at its normal rated illumination.

The inverter $I_v$ constitutes a current-fed, self-resonant, switch-mode converter supply, also known as a push-pull converter which includes primary P1 of transformer T1, the transformer having an inductance setting gap in its core. Transformer T1 is composed of a center tapped primary winding P, a feedback winding F and a high-voltage secondary winding S, composed of a large number of turns of fine magnet wire. Two transistors, Q3 and Q4, are connected so that the emitter/collector pad of each is connected between a respective end of the primary winding P1 and the negative terminal battery BT1 as shown. A low-voltage feedback winding, F, of transformer T1 is connected between the bases of transistors Q3 and Q4 to provide positive feedback from winding F to cause Q3 and Q4 to alternately switch the battery current through primary winding P1 creating the alternating current in secondary winding S.

Timing circuit $T_i$1 controls the high voltage and current necessary to initiate the lighting of lamp LAMP. A mosfet transistor Q2 is connected through its gate to capacitor C5 and its source/drain through relay coil K4 so that on loss of AC power and the operation of switch K2A the firing of transistor Q2 causes current to flow in relay coil K4 and activate relay switches K4A and K4B to direct transformer secondary S output to load LAMP through capacitor C7 for the period of time Q2 conducts (about 10 seconds in the preferred embodiment). Thereafter, the current through relay coil K4 ceases and switch K4B returns to its normally closed condition (as shown) such that capacitor C8 regulates the current to load LAMP.

Timing Circuit $T_i$2 provides the delay of the return of operation of the load LAMP when AC power is returned to the emergency ballast B. Capacitor C4 is charged when the emergency ballast B operates to power load LAMP. When AC power returns, the current to relay coils K1 and K2 cause load LAMP to be switched from output circuit $I_o$ to the AC ballast (not shown) except that as mosfet transistor Q1 fires, being powered by the charge on capacitor C4, current flows in relay coil K3 causing switch K3 to open. Switch K3 is connected in series with the main AC power line to the AC ballast and upon opening it interrupts AC ballast being supplied with AC line power, delaying the turning on of lamp LAMP for a time sufficient (approximately 5 seconds in the preferred embodiment) for the transient currents from the cessation of emergency supply to dissipate. Once transistor Q2 ceases conduction, switch K3 closes and normal supply to load LAMP from the AC ballast resumes.

During normal operation when main AC power supply is provided to the AC ballast and the emergency ballast B, charging current is supplied from the rectifier, D1, to battery BT1, causing the energizing of relay coils K1 and K2 so that the timing circuits $T_t1$ and $T_t2$ and the oscillating switches Q3 and Q4 and the output circuit $I_o$ are inactive. At the time the main AC power supply fails, and for that continuing period of time prior to the AC power returns to normal operation such that input voltage through J1-1 or J1-2 again powers rectifier D1, relays K1 and K2 are de-energized (and associated switches K1A and K1B and K2A assume the normally closed position indicated in FIG. 1) whereby the fluorescent lamp load LAMP is connected to the output circuit $I_o$ and the inverter $I_v$ is triggered into operation.

Upon initial loss of AC power, charging current from the output of diode bridge D1 ceases, causing switch K2A to close (NC position). This allows the battery BT1 to supply current through coil K4 and diode D4 to the drain of transistor Q2. Current is also provided to transistors Q3 and Q4 which are driven into saturation resulting in a current flow through the primary P1 of the inverter Iv. Resistor R12 is given a sufficiently low resistance to supply a base current which will alternately drive transistors Q3 and Q4 to oscillate the battery BT1 current through the primary winding P. Concurrently with the initial conduction of oscillators Q3 and Q4, Q5 conducts, being driven into conduction by current supplied from the battery through relay coil K4 and the residual charge on capacitor C5 holding Q2 on. With Q2 turning Q5 on, additional bias current is provided to oscillators Q3 and Q4 to provide the increased current necessary to strike or initially illuminate the load LAMP. Concurrently with the additional bias current to Q3 and Q4, the current flow in relay coil K4 causes relay switch K4B to supply load LAMP through capacitor C7. Once the charge on capacitor C5 has dissipated to the point that transistor Q2 no longer conducts, Q5 also ceases conducting and oscillators Q3 and Q4 are biased only through R12 and their output decreases to the steady-state switching current of inverter $I_v$. Likewise, current through coil K4 ceases and relay switches K4A and K4B assume the normally closed position shown in FIG. 1 whereby load LAMP is supplied current through capacitor C8 from transformer T.

Once transistors Q3 and Q4 are alternately biased to the on condition, they act effectively as switches drawing current from battery BT1 through their respective emitter/collectors to the center of primary P of transformer T1. Current flow through feedback coil F of transformer T1 effectively diverts the base current to transistors Q3 and Q4 alternatively in a positive feedback mode whereby Q3 and Q4 oscillate in an on and off condition creating an AC current from battery BT1 to the center tap of primary P of transformer T1 which is stepped up to a suitably high AC voltage to run the selected small fluorescent lamps making up the load LAMP by selection of the turns ratio between P and the secondary coil S of transformer T. Resistor R12 functions to limit the current from battery BT1 through the feedback winding F such that transistors Q3 and Q4 are biased appropriately. Likewise, capacitor C6 across the collector circuits of Q3 and Q4 in parallel with the primary winding P serves to smooth the AC current generated by virtue of the alternative switching action of transistors Q3 and Q4 creating the battery supplied AC through primary P.

The output circuit $I_o$ which includes the fluorescent lamp load LAMP to be illuminated attached to terminals J2-1 and J2-2 includes also in the secondary winding S, one of current limiting capacitor C7 or C8 and capacitor C9 across secondary winding S. In operation, when the inverter $I_v$ produced high AC voltage is initially generated at secondary S as switches Q3 and Q4 fire off, assisted by switch Q5, high voltage in the order of 600 hundred volts AC is applied to the fluorescent lamp making up load LAMP. This causes the circuit containing load LAMP, which is essentially capacitive, to receive a voltage spike which ensures that the lamp is started by there being sufficient voltage and current applied to the gases within the lamp to ensure initial conduction. As the lamp initiates its illumination and transistor Q5 shuts down, current will flow through capacitor C8 which is sized to limit the current to fluorescent lamp LAMP at its operational level so that the lamp will provide the requisite illumination in emergency operation. Capacitor C9 across secondary S is also a current limiting impedance in the circuit to ensure that a load is always connected against secondary S.

As AC power is restored to the emergency ballast B, power again flows through charging circuit D1 providing current again through relay coils K1 and K2. Accordingly, relay switch K2A opens (position NO) and terminates the function of the inverter circuit $I_v$. Concurrently as the charge on capacitor C4, which was built up from battery BT1 through D3 during the functioning of the inverter circuit $I_v$, provides a bias to the gate of mosfet transistor Q1. With the bias applied to its gate, transistor Q1 goes into conduction and the charging voltage of diode D1 is applied to the drain of Q1, whereby current is drawn through relay coil K3 causing relay switch K3 to open, interrupting the supply of AC line power to the AC ballast, thereby delaying the start-up of the AC ballast. Once the charge on capacitor C4 has dissipated such that Q1 no longer conducts (about 4 to 5 seconds), current flow in coil K3 ceases and switch K3 resumes its normally closed position (NC) and normal AC ballast operation begins providing power to operate the fluorescent fixtitre (not shown). The delay time is selected to allow the transient voltage and current spikes introduced into the output circuit $I_o$ by the shutting down of emergency ballast to subside such that they are not detected by the end of life cycle circuit in the AC ballast. It should be recognized by those skilled in the art that the sensitivity of the end of cycle circuits of different AC ballasts may require more or less time for the settling of the transients, depending upon those circuits' sensitivity. Such timing adjustments are made by changing the values of capacitor C5 and resistors R7 and R8.

In the embodiment described above and illustrated in FIG. 2, the following components were utilized:

| Designator | Description | Component value/description |
|---|---|---|
| C1 | capacitor | 1.5 uF/250 VDC |
| C2 | capacitor | 2.0 uF250 VDC |
| C3 | capacitor | 220 uF/25 VDC |
| C4, C5 | capacitor | 0.68 uF/63 VDC |
| C6 | capacitor | 0.047 uF/100 VDC |
| C7 | capacitor | 1200 pF/2 kV |
| C8 | capacitor | 330 pF/2 kV |
| C9 | capacitor | 470 pF/2 kV |
| R1, R2, R8 | resistor | 10 MΩ/0.25 W |
| R3 | resistor | 270 Ω/0.25 W |
| R4 | resistor | 47 Ω/0.25 W |
| R5, R7 | resistor | 10 kΩ/0.25 W |
| R6 | resistor | 4.7 MΩ/0.25 W |
| R9 | resistor | 1 kΩ/0.25 W |
| R10 | resistor | not used |
| R11 | resistor | 300 Ω/0.25 W |
| R12 | resistor | 1 kΩ/0.25 W |

-continued

| Designator | Description | Component value/description |
|---|---|---|
| D1 | diode bridge | 1 A, 600 V |
| D2, D3 | diode | 1 A, 600 V |
| D4 | diode | 1N4148 |
| K1, K2 | DPDT relay | 3 V, 45Ω coil |
| K3 | SPDT relay | 5 V, 55Ω coil |
| K4 | DPDT relay | 5 V, 42Ω coil |
| Q1, Q2 | mosfet transistor | 60 V, 0.15A, 0.4 W |
| Q3, Q4 | transistor | 80 V, 5A, 1.2 W |
| L1 | inductor | 100 turns, 25 GA wire |
| BT | nickel-cadmium battery | 7.2 V, 1.5 Ah, subC cell |
| T1 | E187 inverter transformer: | |

| Winding Description | Wire GA | Number of Turns |
|---|---|---|
| Secondary | 35 | 800 |
| Primary | 30 | 9 |
| Primary | 30 | 9 |
| Feedback | 30 | 2 |

The disclosed embodiment is to be considered in all respects as illustrative and not restrictive. The scope of the invention is to be defined by the appended claims rather than the foregoing descriptions and other embodiments which come into the meaning and range of equivalency of the claims are therefore intended to be included within the scope thereof.

What is claimed is:

1. A flourescent lamp emergency ballast for selective addition to an operable fluorescent lamp having an AC ballast and an end of life shut-down circuit including delay circuit means for emergency operation of a fluorescent lamp with power supplied by a battery while power normally supplied to said fluorescent lamp from the internal AC ballast powered by AC power mains is interrupted, comprising:

inverter means for generating an alternating current from energy supplied by the battery including transformer means having two separate primary windings connected in parallel and a secondary winding, each of the primary windings inductively coupled to the secondary winding;

lamp starting means connected to said inverter means for operatively connecting said secondary winding in series with the fluorescent lamp for supplying a first alternating current as a starting current in said fluorescent lamp for a selected period of time;

lamp operating means connected to said inverter means for operatively connecting said secondary winding in series with the fluorescent lamp for supplying a second alternating current as an operating current to said fluorescent lamp for the period said AC power from the AC power mains is interrupted; and timing means responsive to resumption of the supply of AC power by the AC power mains connected to switch means to delay the resumption of AC power to the AC ballast for a predetermined period of time during which said emergency ballast ceases supplying battery current to said inverter, said switch means being connectable intermediate the AC power mains and the AC ballast of the fluorescent lamp;

whereby said timing means responsive to the resumption of AC power delays the restarting of the fluorescent lamp by the AC ballast for a period of time subsequent to the operation of said inverter.

2. The emergency ballast of claim 1 wherein said inverter means includes two power transistors connected in push-pull relation to supply current to a center tap on the first of the two primary windings and the second of the two primary windings is connected to said transistors to cause alternate conduction thereof, whereby an alternating current is supplied by said transistors to said first primary winding.

3. The emergency ballast of claim 1 wherein said timing means responsive to the resumption of supply of AC mains power to the AC ballast includes a relay including open and closed switch contacts and a coil for operating the contacts, said coil being operably connected in series with a transistor, a capacitor connected to the bias of said transistor and charged by said inverter during the period said inverter means is generating alternating current, whereby on resumption of supply by AC power mains, said capacitor discharges through said transistor causing said transistor to conduct and supply current to said relay coil to operate said switch contacts.

4. An AC powered fluorescent lamp with an end of life shut-down circuit connectable to AC power mains, the lamp having an AC ballast for normal operation the fluorescent lamp and an emergency ballast for operation of the fluorescent lamp while power normally supplied to the AC ballast is interrupted, wherein the emergency ballast comprises;

inverter means for generating an alternating current from energy supplied by the battery including transformer means having two separate primary windings connected in parallel and a secondary winding, each of the primary windings inductively coupled to the secondary winding;

lamp starting means connected to said inverter means for operatively connecting said secondary winding in series with the fluorescent lamp for supplying a first alternating current as a starting current in said fluorescent lamp for a selected period of time;

lamp operating means connected to said inverter means for operatively connecting said secondary winding in series with the fluorescent lamp for supplying a second alternating current as an operating current to said fluorescent lamp for the period said AC power from the AC power mains is interrupted; and timing means responsive to resumption of the supply of AC power by the AC power mains connected to switch means to delay the resumption of AC power to the AC ballast for a predetermined period of time during which said emergency ballast ceases supplying battery current to said inverter, said switch means being connectable intermediate the AC power mains and the AC ballast of the fluorescent lamp;

whereby said timing means responsive to the resumption of AC power delays the restarting of the fluorescent lamp by the AC ballast for a period of time subsequent to the operation of said inverter.

5. The fluorescent lamp of claim 4 wherein said timing means in the emergency ballast responsive to the resumption of supply of AC mains power to the AC ballast includes a relay including open and closed switch contacts and a coil for operating the contacts, said coil being operably connected in series with a transistor, a capacitor connected to the bias of said transistor and charged by said inverter during the period said inverter means is generating alternating current, whereby on resumption of supply by AC power mains, said capacitor discharges through said transistor causing said transistor to conduct and supply current to said relay coil to operate said switch contacts.

6. The fluorescent lamp of claim 5 wherein said switch contacts are disposed intermediate the AC ballast and the power connection of the fluorescent lamp to the AC mains.

* * * * *